US005819438A

United States Patent [19]

Wanniarachchi

[11] Patent Number: 5,819,438

[45] Date of Patent: Oct. 13, 1998

[54] METHOD FOR AUTOMATIC SHOE VENTILATION

[76] Inventor: Amarawansa S. Wanniarachchi, 3050 Madison Ave., B12, Fullerton, Calif. 92631

[21] Appl. No.: 435,878

[22] Filed: May 5, 1995

[51] Int. Cl.[6] ..... A43B 7/06

[52] U.S. Cl. ..... 36/3 R; 36/3 A

[58] Field of Search ..... 36/3 R, 3 A, 3 B, 36/29

[56] References Cited

U.S. PATENT DOCUMENTS

| | | | |
|---|---|---|---|
| 490,703 | 1/1893 | Whitehill | 36/3 A |
| 682,182 | 9/1901 | Ellings | 36/3 A |
| 950,333 | 2/1910 | Koch | 36/3 R |
| 1,216,795 | 2/1917 | Gause | 36/3 R |
| 1,364,226 | 1/1921 | Wherry | 36/3 R |
| 2,329,573 | 9/1943 | Ziegliss | 36/3 R |
| 2,354,407 | 7/1944 | Shaks | 36/3 R |
| 2,716,293 | 8/1955 | Rath | 36/3 A |

FOREIGN PATENT DOCUMENTS

| | | | |
|---|---|---|---|
| 376 | 10/1885 | Sweden | 36/3 A |
| 22043 | of 1907 | United Kingdom | 36/3 R |
| 357391 | 9/1931 | United Kingdom | 36/3 A |

*Primary Examiner*—M. D. Patterson

[57] ABSTRACT

A simple and reliable mechanical design and method for providing positive air ventilation for shoes, sneakers and the like, including an air pump secured to the top, forward portion of the shoe instep, and the air pump being operated by a push-pull element that takes advantage of the deflection of the instep portion of the shoe upper in response to the walking or running action of the shoe wearer.

5 Claims, 3 Drawing Sheets

11
14
20
26
FI
42
43
22
12
24
18
16

11
20
14
26
FE
42
43
22
12
24
18
15
16
17
21
19

14
44
12
45
46
FI
18
47
16

14
45
46
44
FE 18
47
12
16

FIG. 5A
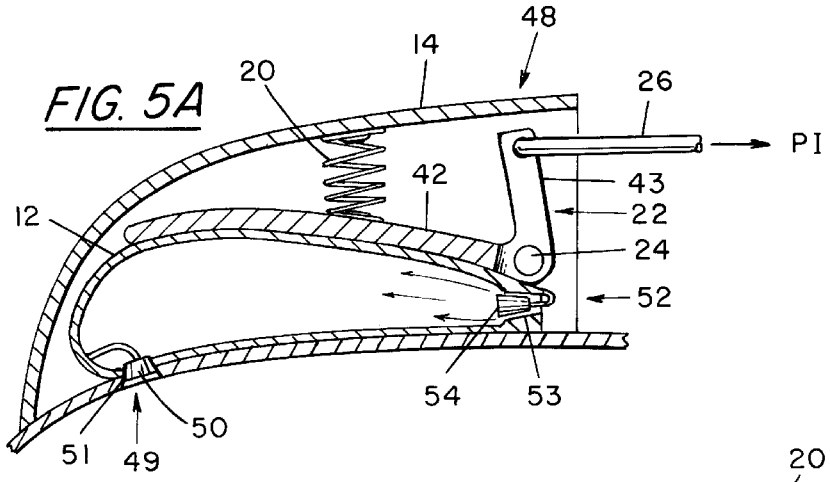
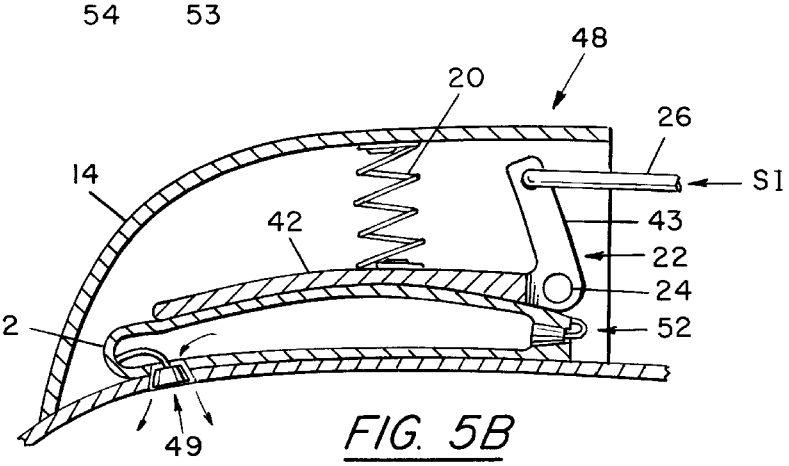
FIG. 5B
FIG 6A
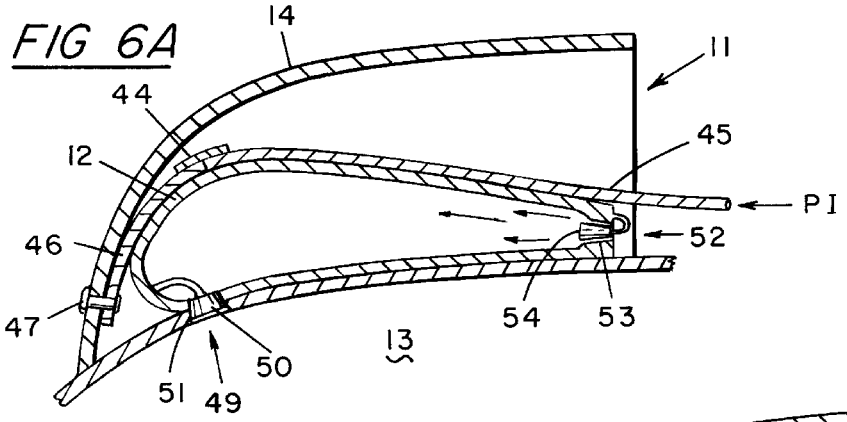
FIG. 6B
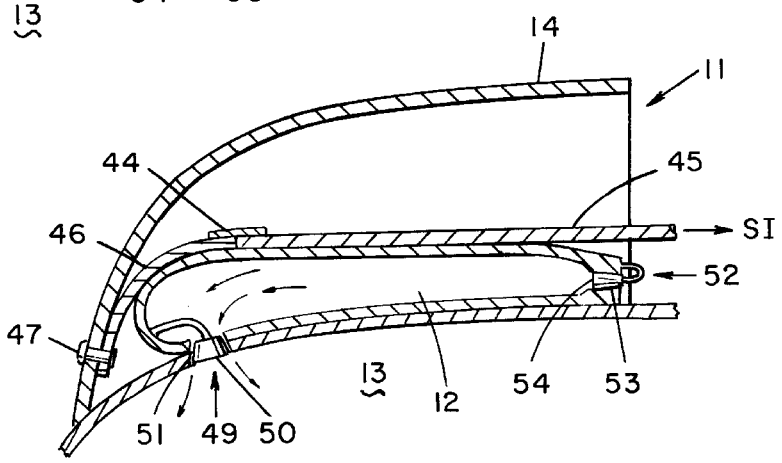

METHOD FOR AUTOMATIC SHOE VENTILATION

BACKGROUND OF THE INVENTION

1. Field of the Invention

The present invention relates to a positive air ventilation system for shoes, and more particularly, but not by way of limitation, to tennis shoes or sneakers used by athletes.

2. Description of the Prior Art

Shoes do not have any active means for ventilating the air space about the inside of the front portion of the shoes where the shoe wearer's toes are housed.

It is well known in the prior art that the shoe wearer's toes are confined in the forwardmost area of the shoe. This area is typically a closely confined area. Because of these close confines, the toes are most prone to a sweaty, enclosed environment. As a result, in such a confined air space, the air becomes saturated with excessive moisture very quickly.

In addition, this confined closed space becomes warm fairly quickly. Such a warm, wet and confined environment promotes the growth of various types and kinds of fungi which leads to the creation of various undesirable and unwanted foot diseases and odors.

Shoes are fashioned out of various types of materials. Leather is one such material. One of the reasons for using leather as a material for constructing shoes is that leather is noted for its ready absorption of water vapors and foot sweat. As long as the leather is not fully saturated, it will continue to absorb the entrapped water vapors and foot sweat formed about the wearer's foot. Even so, while the use of leather in the construction of shoes is most desirable for these reasons, the use of leather does not prevent the growth of fungi and bacteria because the enclosed, confined space in and about the toes still is ladened with stale and moist air and it is not until the shoe is removed by the wearer that the sweat and water vapor will be slowly exhausted from in and around the toes. By that time, both fungi, bacteria and odors will have developed, along with possible foot disease.

One such wide-spread foot disease is *tinea pedis* which is commonly known as "Athlete's Foot". Athlete's foot is a highly contagious disease. It is a long-term fungal infection of the foot. It occurs especially on the skin between the toes and on the soles. It is common worldwide. It is usually caused by TRICHOPHYTONMENTAGROPHYTES, *T. RUBRUM,* and *EPIDERMOPHYTON FLOCCOSUM.* The fungus which causes it is readily passed from person to person via direct contact with contaminated surfaces of the infected foot or feet, or, more specifically, the deck of a swimming pool or the floors of shower rooms, locker rooms, bathrooms, etc. The wearing of constricting footwear, as sneakers, seems to induce the infection.

The use of materials which do not absorb water or water vapor, such as plastics and the like, which are used in the construction of shoes presents even greater and more difficult problems owing to the fact that the sweat and water vapor in and about the wearer's toes is not absorbed at all as is the case when leather is used.

The use of a combination of plastic and cotton material, such as cotton terry cloth material, and the like, offer some advantageous compromises relative to this problem when used in the construction of shoes. Nevertheless, even such advantageous compromises fail to significantly reduce the formation of sweat, along with unwanted odors, and the promotion of the growth of fungi, all of which present opportunities for disease and bacterial infections in and about the toes which are readily spread to other parts of the foot.

In the prior art, a number of inventors have used positive air ventilation systems for closed-toe shoes and boots. However, they represent cumbersome designs with questionable durability and some are suitable only for boots. The invention described within provides a simple design for positive air ventilation to closed-toe shoes without the disadvantages inherent in the inventions described in prior art.

SUMMARY OF THE INVENTION AND OBJECTS OF THE INVENTION

The present invention comprises a foot-actuated pump that removes the moist air from sneakers and shoes alike. This will allow the replenishment of the space within the shoe and the foot with fresh air. The driving action of the pump will be carried out by the actual movement of the wearer's foot or engagement of the shoe with the ground during walking, running or marching.

Fundamentally, the instant invention consists of a mechanical design and method for providing positive air ventilation for shoes, sneakers and the like, including air pump means secured to the forward portion of the shoe, the air pump means having a first air valve operably disposed in fluid communication between the air pump means and the inside of the forward portion of said shoe, and a second air valve operably disposed in fluid communication between the air pump means and the atmosphere surrounding the shoe for controlling the flow of air therebetween, housing means for the air pump secured to the top of the shoe disposed above the toes, and mechanical means connected to the shoe for operating the air pump in response to the movement of the shoe by the foot.

It is one important and significant object of the present invention to provide a foot-actuated means for continuously replenishing the interior space of the shoe surrounding the toes of the wearer with fresh air.

Another important and significant object of the instant invention is to provide a positive air ventilation system for shoes.

One primary and important object of the within invention is to provide a positive air ventilation system which is powered by the movement of the shoe by the wearer's foot.

Still further objects and features of this invention reside in the provision of air ventilation for shoes that is of a simple construction, and having relatively few parts.

A further object of the present invention resides in the design of a positive air ventilation system for shoes of inexpensive and durable construction.

Another important and primary object of the invention is to provide a new and useful means for ventilating the toe area inside of a closed-toe shoe to improve the comfort in wearing such shoes and to significantly reduce the incidence of fungal and bacterial growth which causes foot disease and creates undesirable foot odors.

These, together with the various ancillary objects and features of the invention which will become apparent as the following description proceeds, are attained by this invention, preferred embodiments thereof being shown in the accompanying drawings, by way of example only, wherein:

BRIEF DESCRIPTION OF THE DRAWINGS:

FIG. 5A is an enlarged elevational view of another embodiment of the instant invention illustrating the air pump mechanism as it is receiving air into the air pump.

FIG. 5B is an enlarged elevational view of the alternate embodiment of the instant invention as shown and depicted in FIG. 5A, shown partially in section, depicting the air pump mechanism as it is delivering air, from inside of the air pump to inside of the shoe.

FIG. 6A is an enlarged elevational view of yet another alternative embodiment of the present invention as illustrating the air pump mechanism as it is receiving air into the air pump.

FIG. 6B is an enlarged elevational view of the alternate embodiment of the instant invention as shown and depicted in FIG. 6A depicting the air pump mechanism as it is delivering air from inside of the air pump to the inside of the shoe.

DESCRIPTION OF THE PREFERRED EMBODIMENTS OF THE INVENTION

Figure 1A:
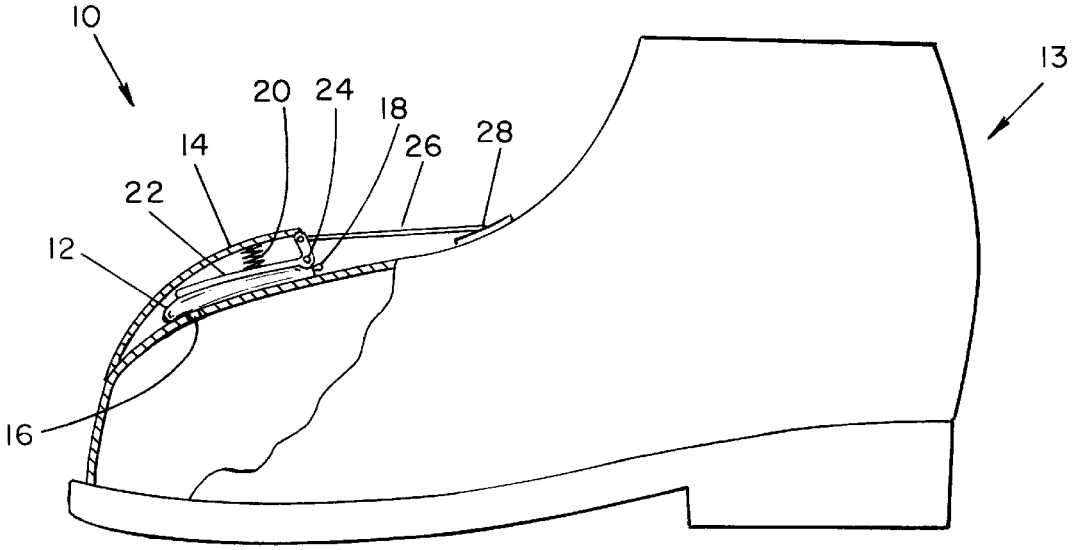
FIG. 1 is a side elevational view, partially in section, of a shoe incorporating one embodiment of the present invention outside the top forward portion of the shoe above where the toes are typically situated.
Figure 1B:
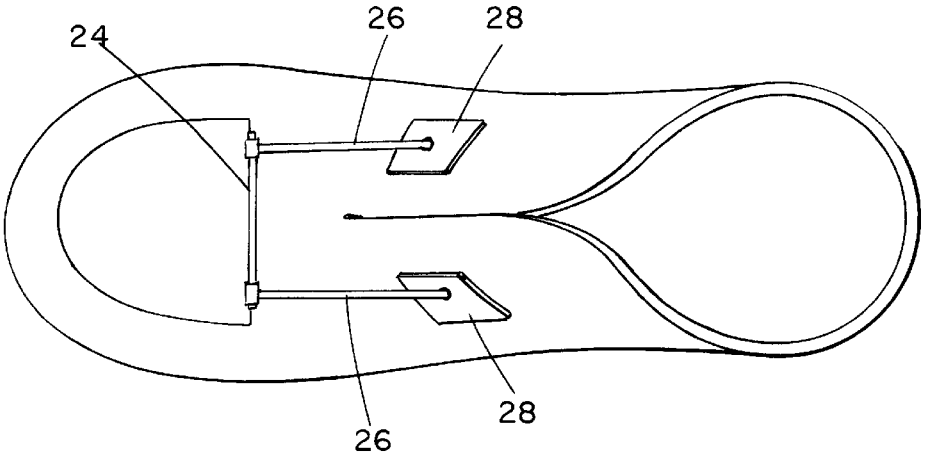
Figure 3:
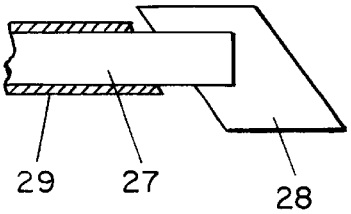
FIG. 3 is an enlarged plan view of a portion of a band incorporated as a push-pull mechanism instead of the push-pull element depicted and shown in FIG. 1.

Referring now to all of the drawings, and, more particularly at this time to FIG. 1, there is shown and illustrated atypical shoe generally indicated at 13. Basically, the instant invention is referred to as a positive shoe ventilation system, generally indicated at 10, which consists of a mechanical design and method for providing positive air ventilation for shoes 13, sneakers and the like, including air pump means 11 secured to the forward portion 41 of the shoe 13, the air pump means 11 having an air inlet valve 16 operably disposed in fluid communication via the opening between the bladder element 12 of the air pump means 11 and the inside of the forward portion 41 of the shoe 13 disposed above the toes of the wearer of the shoe 13, and an air exhaust valve 18 operably disposed in fluid communication between the bladder element 12 of the air pump means 11 and the atmosphere surrounding the shoe 13 for exhausting the air received into the bladder element 12 of the air pump means 11 from inside of the shoe 13, pump housing means 14 for the air pump means 11 secured to the top of the shoe 13 disposed above the toes of the shoe wearer, and mechanical means connected to the shoe 13 for operating the air pump means 11 in response to the movement of the shoe 13 by the foot of the wearer of the shoe 13.

Figure 2A:
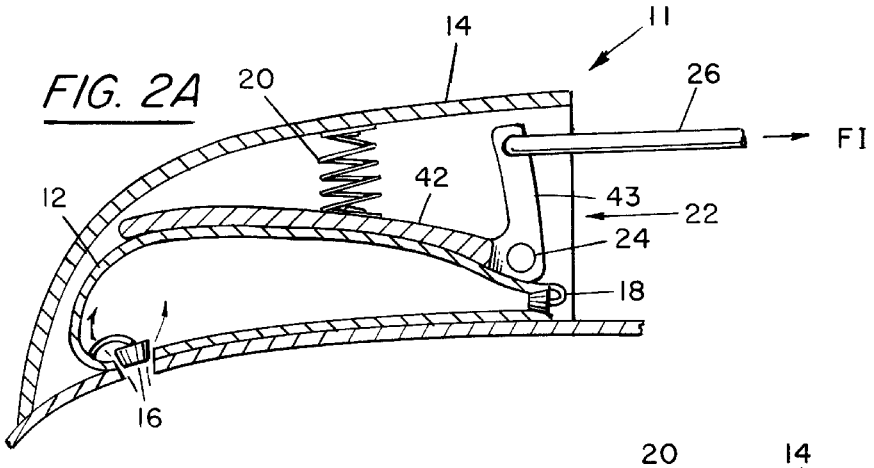
FIG. 2A is an enlarged view of the embodiment of the present invention also incorporated in FIG. 1 depicting the pump mechanism as it is receiving air from inside of the shoe into the pump.
Figure 2B:
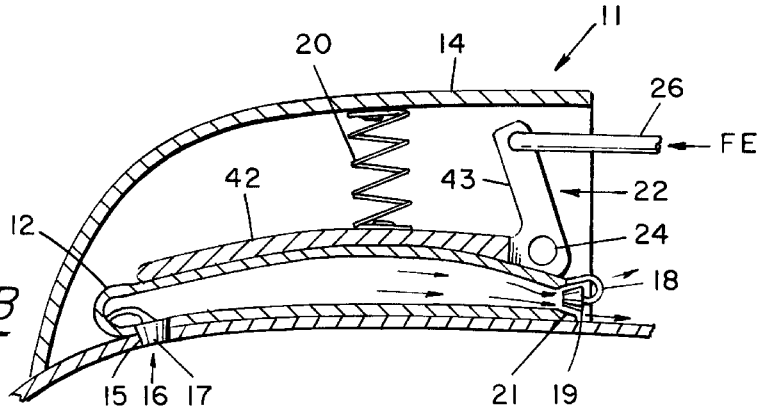
FIG. 2B is an enlarged view of the embodiment of the present invention also incorporated in FIG. 1 depicting the pump mechanism as it is exhausting air from inside of the pump to the atmosphere outside of the shoe.

Preferably, the bladder element 12 of the pump means 11 is made of a durable rubber material and, as depicted in FIGS. 1, 2A and 2B, are placed outside the shoe 13 about the toes of the shoe wearer.

The mechanical means connected to the shoe 13 for operating the air pump means 11 in response to the movement of the shoe 13 by the foot of the wearer of the shoe 13, is shown and illustrated in FIGS. 1, 2A, and 2B, and 3 and consists of a pump housing 14, a bladder element 12 of the air pump means 11, an inlet valve 16 in the bladder element 12 of the pump means 11 for receiving the stale air inside of the shoe 13 and into the bladder element 12 of the air pump means 11, an exhaust valve 18 in the bladder element 12 of the pump means 11 for exhausting the stale air from the bladder element 12 of the pump means 11 into the atmosphere surrounding the shoe 13, and a pair of push-pull elements 26 which are anchored at one end to an anchoring pad 28 to the body of the shoe 13, with the opposite end of the push-pull element 26 being coupled to a bell crank element 22. The bell crank element 22 consists of a spoon-like element 42, a pivot pin 24, and an arm 43. The end of the push-pull element 26 is secured to the arm 43 via a hole near the end thereof.

With special emphasis now on FIG. 1, the mechanical means operates as follows. As the foot of the wearer of the shoe 13 walks, the arch of the instep of the foot moves in arcuate fashion. Since the pair of push-pull elements 26 are anchored at one end to an anchoring pad 28 which, in turn, is anchored to the body of the shoe 13, the push-pull elements 26 are caused to move in synchronism therewith. Of course, the opposite ends of the push-pull elements 26 are not fixed anchored to the shoe 13, but to the arm 43 via a hole near the end of the arm 43, the arm 43 is caused to move in arcuate fashion about the pin 24. This, in turn, causes the spoon-type element 42 to move about the pin 24 as well, moving the spoon-type element 42 towards and away from the bladder-type element 12 of the air pump means 11 in synchronization with the movement of the arm 43 of the bell crank element 22. So, when the instep of the wearer of the shoe 13 is moved forwardly as the metatarsal arch of the foot is bent, then, as shown in FIG. 2B, the force (Force Exhaust) FE is applied in a forwardly direction causing the arm 43 to be moved forward and to pivot about the pin 24. In turn, the spoon-like element 42 is caused to move downwardly against the air bladder element 12 of the air pump means 11 thereby compressing the air bladder element 12. The spring means, here shown for the sake of convenience as a helically wound metal spring 20, which is secured at one end to the pump housing 14 and at the other end to spoon-like element 42, acts to assist in directing the movement of the spoon-like element 42 either against the air bladder element 12 during the exhaust phase shown in FIG. 2B, or the spring 20 can be set up to act in just the opposite fashion. In short, the spring 20 can be biased to act in either fashion, as desired. Actually, the spring 20 is an optional element which may or may not be used as desired. During the exhaust phase, the exhaust valve 18 opens as shown in FIG. 2B. The exhaust valve 18 is opened when the air pressure inside of the air bladder element 12 is increased owing to the movement of the spoon-like element 42 against the air bladder element 12. Such movement causes the inlet valve 16 to go to its closed position as the inlet valve plug 17 is caused to move by the forces created by the differential air pressure between the air inside of the air bladder element 12 and the air pressure inside of the shoe 13 to increase the air pressure inside of the air bladder element 12 over the air pressure inside of the shoe 13. The result is that the inlet valve plug 17 is caused to move into fluid sealing engagement with the inlet valve seat 15 thereby plugging the air passageway between the air bladder element 12 and the inside of the shoe 13 preventing the passage of air therebetween. Additionally, the exhaust valve 18 is acted upon by the forces created by the air pressure differential between the atmospheric pressure and the air pressure inside of the air bladder element 12 causing the exhaust valve plug 19 to be forced out of its fluid-sealing engagement with exhaust valve seat 21, thereby exhausting the air inside of the air bladder element 12.

Turning to FIG. 1, it should be noted now that two push-pull elements 26 are complementarily disposed on either side of the shoe 13 each of which is connected to the bell crank element 22 to operate said bell crank element 22.

A housing 14 for the air pump means 11 is provided, as shown in the figures, to protect the mechanical means whereby the air pump means 11 is made operationally functional.

Figure 4A:
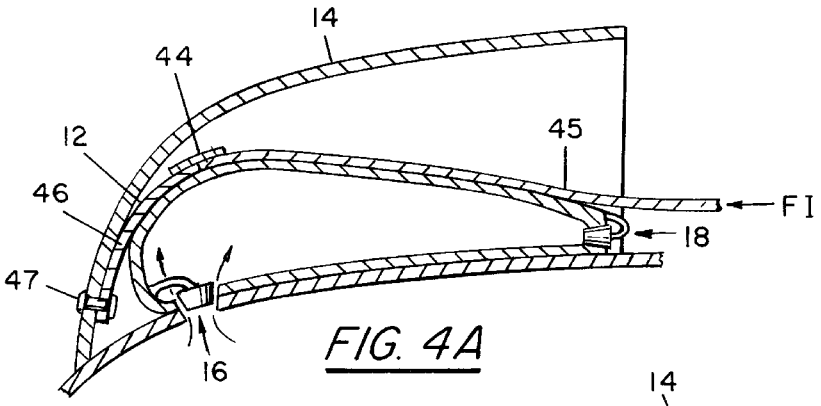
FIG. 4A is an enlarged view of yet another embodiment of the present invention depicting the air pump mechanism as it is receiving air from inside of the shoe into the air pump.
Figure 4B:
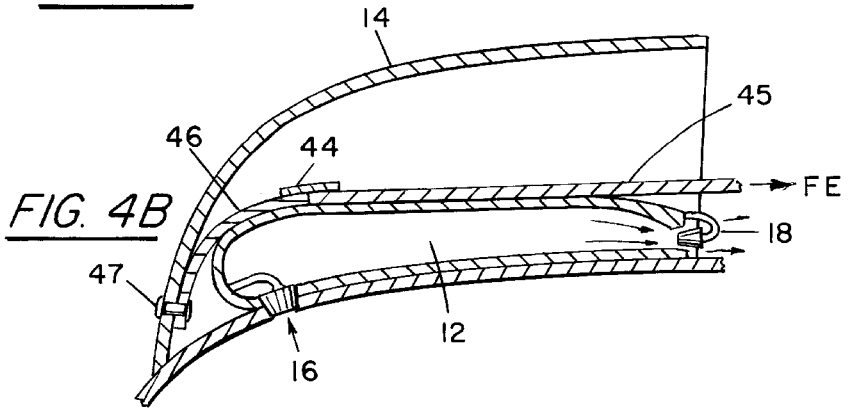
FIG. 4B is an enlarged elevational view of the embodiment shown and depicted in FIG. 4A, shown partially in section, depicting the air pump mechanism as it is exhausting air from inside of the air pump to the atmosphere outside of the shoe.

A further embodiment of the instant invention is shown in FIGS. 4A and 4B. Instead of a bell crank mechanism 22 as described in the other embodiments disclosed herein, one or more push-pull elements 45 are positioned in direct contact with the air bladder element 12 and depending on the movement of the push-pull elements 45, the air bladder element 12 is compressed or not compressed. With special emphasis now on FIG. 4A, the flexible push-pull element 45 is anchored at one end to the shoe 13 via an anchoring pad 28 (not shown in FIGS. 4A or 4B, but shown in FIG. 1), and at the other end the flexible push-pull element 45 is coupled via a crimped sleeve 44 to a cantilevered spring element 46. In turn, the other end of the cantilevered spring element 46 is secured to the housing 14 by a fastener, such as a rivet 47, or the like.

When the FI (Force Inlet) is applied to the flexible push-pull element 45, the combination of the FI applied to the flexible push-pull element 45 and the cantilevered spring element 46 acts to expand the air bladder element 12 as shown. The air inlet valve 16 is opened and the air flows from inside of the shoe 13 into the air bladder element 12. At the same time, the air exhaust valve 18 is closed in fluid sealing engagement as previously described and noted elsewhere herein. The FI is applied when the arch of the instep of the foot of the wearer is bent.

When the instep of the foot of the wearer assumes a flat position, the FE (Force Exhaust) is applied to the flexible push-pull element 45 and the air bladder element 12 is compressed as shown in FIG. 4B. The air exhaust valve 18 is opened allowing the air inside of the air bladder element 12 to be exhausted therefrom and, at the same time, the air inlet valve 16 is forced shut.

As the foot of the shoe wearer is again bent, the FI is applied and the cantilevered spring element 46 helps to draw the flexible push-pull element 45 into the uncompressed condition of the air bladder element as shown in FIG. 4A.

With special reference now to FIG. 8, there is shown the use of a tape-type push-pull element 27 with a casing 28 as an alternative to the use of a rod-type push-pull element 26, 34 as hereinbefore described.

Continuing now with a description of yet another embodiment of the present invention as shown and described in FIGS. 5A and 5B, it consists of a pump housing 14, a bladder element 12 of the air pump means 48, an air inlet valve 52 in the bladder element 12 of the air pump means 48 for receiving the air outside of the shoe 13 and into the bladder element 12 of the air pump means 48, an air exhaust valve 49 in the bladder element 12 of the air pump means 11 for exhausting the air from the bladder element 12 of the air pump means 11 into the inside of the shoe 13, and at least one push-pull element 26 which is anchored at one end to an anchoring pad 28 to the body of the shoe 13, with the opposite end of the push-pull element 26 being coupled to a bell crank element 22. The bell crank element 22 consists of a spoon-like element 42, a pivot pin 24, and an arm 43. The opposite end of the push-pull element 26 is secured to the arm 43 via a hole near the end of the arm 43. A bias spring 20 is disposed between the pump housing 14 and the spoon-like element 42 to assist in the movement of the spoon-like element 42 against and away from the bladder element 12 as the bladder element 12 is expanded and compressed.

When the foot of the wearer is flat on the ground, a force, PI (Pump Inlet), is applied via the push-pull element 26 to the arm 43 of the bell crank element 22, wherein the arm 43 is moved to a position as shown in FIG. 5A thereby moving the spoon-like element 42 so that the bladder element 12 is fully expanded. As this is accomplished, the air inlet valve 52 is opened and the air outside of the shoe 13 is drawn into the bladder element 12 thereby filling the inside of the bladder element 12 with air. At the same time, the valve plug 50 is forced into fluid sealing engagement with the valve seat 51 of the air valve 49, thereby preventing the passage of air therethrough.

As the metatarsal arch of the wearer's foot is flexed, a force, SI (Shoe Inlet), is applied via the push-pull element 26 to the arm 43 of the bell crank element 22, wherein the arm 43 is moved to a position as shown in FIG. 5B thereby moving the spoon-like element 42 so that the bladder element 12 is compressed. As this is accomplished, the air inlet valve 52 is closed and the air inside of the bladder element 12 acts to move the valve plug 50 away from its former fluid sealing engagement with the valve seat 51 of the air valve 49, thereby allowing the passage of air from inside of the bladder element 12 through the air valve 49 into the inside of the shoe 13.

In FIGS. 6A and 6B, there is shown, in detail, yet another embodiment of the present invention. As depicted, there is shown within the pump housing 14 in which the air pump mechanism 11 is situated, a bladder element 12, at least one flexible push-pull element 45, one end of which is anchored to the shoe 13 via an anchor pad 28 (not shown in FIGS. 6A or 6B, but shown and described in FIG. 1) and the other end is connected to a cantilevered spring element 46 via a crimped sleeve 44. The other end of the cantilevered spring element 46 is secured via a rivet 47 to the forward portion of the shoe 13. As shown, the bladder element 12 contains a pair of air valves 49 and 52. Air valve 49 has a valve plug 50 and a valve seat 51. Air valve 52 has a valve plug 54 and a valve seat 53.

As shown in FIG. 6A, when the shoe 13 contacts the ground and the shoe 13 is flexed, the force, PI (Pump Inlet), is impressed upon the flexible push-pull element 45 at the end nearest the push-pull element's 45 end which is anchored to the anchoring pad 28 (shown on FIG. 3, but not shown in FIGS. 6A or 6B), and, at the opposite end of the flexible push-pull element 45, which is coupled to the unanchored end of the cantilevered spring element 46 via a crimped sleeve 44, the cantilevered spring element 46 flexes upwardly, all of which allows the air inside of the bladder element 12 to be uncompressed. As such occurs, the air outside of the shoe 13 is drawn into the bladder element 12 via the air valve 52 as the valve plug 54 is unseated from the valve seat 53. Correspondingly so, the other air valve 49 is closed as the valve plug 50 engages the valve seat 51. When the air valve 49 is closed, no air passes therethrough. The air valve 49 is operably connected in fluid communication with the shoe 13.

Turning now to FIG. 6B, as the shoe 13 disengages the ground and is not flexed, the force, SI (Shoe Inlet), is applied to the flexible push-pull element 45 which is drawn downwardly and presses against the bladder element 12, thereby compressing the air inside of the bladder element 12. The cantilevered spring element 46 is depressed, or drawn downwardly, as shown, by the force, SI, applied to the flexible push-pull element 45. As this occurs, the air valve plug 50 is unseated from the valve seat 51 as a result of the action thereon and the valve 49 opens thereby allowing the compressed air inside of the bladder element 12 to flow from the inside of the bladder element 12 to the inside of the shoe 13. As a consequence, once the air enters the shoe 13, the air circulates throughout the toes and inside of the shoe 13 about the wearer's foot thereby ventilating the shoe 13.

With respect to all of the embodiments herein, it should be noted that the bladder element 12 may be secured to the spoon-like element 42 by glue so that the bladder element 12 will move together with the movement of the spoon-like element 42.

It should be noted at this time that it is necessary for the shoe to engage and disengage its sole with the ground during walking, running or marching in order for the within invention to operate. It is also necessary for the metatarsal arch of the foot to be flexed. Disclosed herein, in order for the within invention to operate, the shoe 13 must be engaged and/or disengaged with the ground.

Method of Positive Air Ventilation of Closed-Toe Shoes

The fabrication of the designs shown in FIGS. 1, 2, 2B, 5A and 5B herein may proceed as follows. Attach bell crank element 22 and spring means 20 to pump housing 14. Attach push-pull element 26 to arm 43. Attach air bladder means 12 to the spoon-like element 42. Attach the pump housing 14 and air bladder means 12 to the top toe area of shoe 13. Finally, attach the free end of push-pull element 26 to the shoe 13 through anchoring pad 28.

The fabrication of the designs shown in FIGS. 4A, 4B, 6A and 6B herein may proceed as follows. Attach cantilevered spring means 46 to pump housing 14. Attach push-pull element 26 to cantilevered spring means 46. Attach air bladder means 12 to the cantilevered spring means 46. Attach the pump housing 14 and air bladder means 12 to the top toe area of shoe 13. Finally, attach the free end of push-pull element 26 to the shoe 13 through anchoring pad 28.

A first new method for effectuating a positive air ventilation system for use in closed-toe shoes, including- the steps of engaging the sole of the shoe with the ground, moving the push-pull element means to actuate the air pump means, moving the air between the outside of the shoe and the air pump means, moving the air between the air pump means and the inside of the closed-toe shoe by the disengagement of the shoe with the ground to exhaust the air from inside of the shoe.

A second new method complementary to the first new method for effectuating a positive air ventilation system for use in closed-toe shoes, including the steps of engaging the sole of the shoe with the ground, moving the push-pull element means to actuate the air pump means, moving the air from the inside of the shoe into the air pump means, moving the air between the air pump means and the outside of the closed-toe shoe by the disengagement of the shoe with the ground.

The foregoing constitute my disclosure of the best mode known by me at the time of filing this patent application for carrying out this invention. The embodiment shown is, however, only illustrative and does not limit the scope of the inventive concept. It is recognized that one of skill in the molding art may produce an operative assembly which may have differences without departing from the true concept of this invention. Therefore, this invention is defined, not by the illustrative embodiment but rather by the following claims including the protection afforded by the Doctrine of Equivalents.

What I claim as my invention is:

1. A shoe with a ventilation system comprising:

(a) an air pump means secured to said shoe and located in the top toe area thereof, (b) a housing means secured outside of said shoe and on the top toe area of said shoe, said air pump means being located in said housing to provide protection to said air pump means, (c) a push-pull element means for operating said air pump means anchored to the center of the instep with clearance from a lace area of said shoe, said push-pull element means further providing means for alternately creating movements in forward and backward directions owing to the flexing of the instep of said shoe in response to walking or running action of the wearer of said shoe, said movement of said push-pull element means alternately providing compressing and expanding of said air pump means, (d) a first air valve means being operatively disposed in fluid communication between said air pump means and the inside of said shoe for controlling the flow of air therebetween, (e) a second air valve means being operatively disposed in fluid communication between said air pump means and the atmosphere surrounding said shoe for controlling the flow of air therebetween, whereby stale moist air within said shoe will be replenished by fresh air to substantially improve comfort of the wearer of said shoe.

2. The improved shoe ventilation system of claim 1, wherein said push-pull element means moves forward when the foot of the wearer is behind of his or her body, said push-pull element means moves backward when the foot of the wearer is in front of said body during normal walking or running.

3. The improved shoe ventilation system of claim 1, wherein said air pump means consists of an air bladder means.

4. The improved shoe ventilation system of claim 1, wherein said push-pull element means operably coupled to a cantilevered spring means attached to the inside of said housing means, said cantilevered spring means moves up as said push-pull element means moves forward thereby providing expansion of said pump means, said cantilevered spring means moves down as said push-pull element means moves backward thereby allowing compression of said air pump means.

5. The improved shoe ventilation system of claim 4, wherein said cantilevered spring means is secured to said air pump means.

* * * * *